US010562652B2

(12) United States Patent
Gross-Johnston et al.

(10) Patent No.: US 10,562,652 B2
(45) Date of Patent: Feb. 18, 2020

(54) SPOUTED SACHET

(71) Applicant: H.J. Heinz Company Brands LLC, Pittsburgh, PA (US)

(72) Inventors: Callie Gross-Johnston, Lake Villa, IL (US); Lauren Chard, Evanston, IL (US); William Burns, Minneapolis, MN (US)

(73) Assignee: H.J. Heinz Company Brands LLC, Pittsburgh, PA (US)

( * ) Notice: Subject to any disclaimer, the term of this patent is extended or adjusted under 35 U.S.C. 154(b) by 0 days.

(21) Appl. No.: 15/941,782

(22) Filed: Mar. 30, 2018

(65) Prior Publication Data

US 2019/0177016 A1 Jun. 13, 2019

Related U.S. Application Data

(60) Provisional application No. 62/597,835, filed on Dec. 12, 2017.

(51) Int. Cl.
*B65B 9/02* (2006.01)
*B65D 75/58* (2006.01)
*B65D 85/72* (2006.01)

(52) U.S. Cl.
CPC ..... *B65B 9/023* (2013.01); *B65D 75/5811* (2013.01); *B65D 75/5866* (2013.01); *B65D 85/72* (2013.01); *B65D 2221/00* (2013.01)

(58) Field of Classification Search
CPC . B65B 9/023; B65D 75/5811; B65D 75/5866; B65D 85/72
USPC ..... 222/107
See application file for complete search history.

(56) References Cited

U.S. PATENT DOCUMENTS

| | | | | |
|---|---|---|---|---|
| 2,329,360 | A | 9/1943 | Salfisberg | |
| 2,962,192 | A | 11/1960 | Volckening | |
| 3,156,355 | A | 11/1964 | Rodgers | |
| D336,034 | S | 6/1993 | Rebilas | |
| D347,993 | S | 6/1994 | Lane, Jr. | |
| D354,906 | S | 1/1995 | Lane, Jr. | |
| 5,411,178 | A | 5/1995 | Roders | |
| D375,676 | S | 11/1996 | Davis | |
| 5,632,416 | A * | 5/1997 | Lane, Jr. | B05C 17/00583 222/105 |
| 5,931,345 | A | 8/1999 | Lane, Jr. | |
| D416,477 | S | 11/1999 | Flint | |
| D448,661 | S | 10/2001 | Kerr | |
| 6,435,374 | B1 * | 8/2002 | Tabaroni | B65D 75/32 222/107 |
| 6,557,731 | B1 * | 5/2003 | Lyon | B65D 75/5811 222/107 |
| D484,972 | S | 1/2004 | Steele, IV | |

(Continued)

OTHER PUBLICATIONS

Kraft-Heinz, "Tomato Ketchup," picture of front of packet believed to be in public use on or before Dec. 28, 2016.

(Continued)

*Primary Examiner* — Jeremy Carroll
(74) *Attorney, Agent, or Firm* — Fitch, Even, Tabin & Flannery LLP

(57) ABSTRACT

Described herein are a packaged food product and methods of making and using the packaged food product. In some embodiments, the packaged food product comprises a spouted sachet or packet containing one or more flowable food products, such as ketchup or other condiments.

20 Claims, 5 Drawing Sheets

(56) References Cited

U.S. PATENT DOCUMENTS

| | | | | |
|---|---|---|---|---|
| D523,758 | S | 6/2006 | Risgalla | |
| D620,809 | S | 8/2010 | Rasile | |
| D621,719 | S | 8/2010 | Rasile | |
| D623,072 | S | 9/2010 | Rasile | |
| D623,073 | S | 9/2010 | Rasile | |
| D623,074 | S | 9/2010 | Rasile | |
| D623,643 | S | 9/2010 | Hsu | |
| D628,903 | S | 12/2010 | Rasile | |
| D629,702 | S | 12/2010 | Rasile | |
| D632,560 | S | 2/2011 | Rasile | |
| D632,564 | S | 2/2011 | Rasile | |
| D632,565 | S | 2/2011 | Rasile | |
| D632,566 | S | 2/2011 | Rasile | |
| D632,567 | S | 2/2011 | Rasile | |
| D632,568 | S | 2/2011 | Rasile | |
| D632,569 | S | 2/2011 | Rasile | |
| D632,570 | S | 2/2011 | Rasile | |
| D634,643 | S | 3/2011 | Rasile | |
| D640,921 | S | 7/2011 | Rasile | |
| D641,642 | S | 7/2011 | Rasile | |
| D644,101 | S | 8/2011 | Rasile | |
| 8,061,563 | B1 | 11/2011 | Rosen | |
| D652,298 | S | 1/2012 | Rasile | |
| D652,718 | S | 1/2012 | Rasile | |
| D652,719 | S | 1/2012 | Rasile | |
| D660,718 | S | 5/2012 | McDermott | |
| D660,719 | S | 5/2012 | McDermott | |
| D661,201 | S | 6/2012 | Schroeder | |
| D662,833 | S | 7/2012 | Sanfilippo | |
| D663,631 | S | 7/2012 | McDermott | |
| D669,367 | S | 10/2012 | McDermott | |
| D670,573 | S | 11/2012 | McDermott | |
| D676,334 | S | 2/2013 | McDermott | |
| D682,710 | S | 5/2013 | McDermott | |
| 9,061,796 | B2 | 6/2015 | Caldwell | |
| 2002/0136470 | A1* | 9/2002 | Richardson | B65D 75/566 383/200 |
| 2005/0169970 | A1* | 8/2005 | Aquino | A23L 2/02 424/439 |
| 2007/0034647 | A1 | 2/2007 | Patrick | |
| 2007/0228073 | A1 | 10/2007 | Mazzarino | |
| 2010/0270330 | A1* | 10/2010 | Caldwell | B65D 21/0202 222/107 |
| 2010/0320206 | A1* | 12/2010 | Caldwell | B65D 75/563 220/266 |
| 2011/0259917 | A1* | 10/2011 | West | B65D 75/20 222/107 |

OTHER PUBLICATIONS

Kraft-Heinz, "Tomato Ketchup," pictures of fronts of four packets believed to be in public use on or before Dec. 28, 2016.

Slopeside Syrup, "Untapped All-Natural Athletic Fuel," p. 1—picture of front of packet, p. 2—picture of back of packet believed to be in public use on or before Dec. 1, 2017.

Smuckers, "Concord Grape Jam and Strawberry Jam," pictures of fronts of packets believed to be in public use on or before Dec. 1, 2017.

Waffle House, "Lite Italian Dressing," picture of back of packet believed to be in public use on or before Dec. 8, 2017.

Heinz Tomato Ketchup Packet. Picture of a packet representative of packets believed to have been in public use before Dec. 11, 2016. Such packets comprise a first film and a second film sealed together. It is believed that such packets were capable of containing ketchup for a period of at least nine months at temperatures of 68° F. To 78° F. without significant degradation of the film or ketchup.

* cited by examiner

SPOUTED SACHET

FIELD

This application relates generally to food packaging, and more particularly to sachets for dispensing single-serve portions or other small portions of flowable comestibles such as condiments.

BACKGROUND

To provide large numbers of condiment sachets in high-speed operations, sachets may be formed in continuous or intermittent processes wherein sealing and cutting operations are performed on two webs of laminated material to form, fill, and seal individual rectangular sachets. Several sachets may be formed, filled, and sealed simultaneously and in parallel, e.g., in an 8-across, 10-across or 12-across configuration. Means to facilitate tear initiation, such as V-notches or edge cuts, may be provided simultaneously or in separate, post-forming operations. Some sachets include means to help control propagation of tearing after initiation, such as a perforation. In some cases, means may be provided to facilitate removal of a corner of the sachet.

Potential Issues that may affect consumer satisfaction levels with ketchup sachets commonly used in fast-food restaurants in the United States include: (1) difficulty directing ketchup with sufficient precision onto a desired area of a food item or dipping location; (2) undesirably high flow rates, which may result in dispensing excessive amounts of ketchup; (3) undesirably low flow rates, which may result in frustration with the time required to dispense an optimal volume; (4) difficulty in dispensing ketchup from certain regions of the sachet, e.g., corner areas; (5) undesired expulsion of ketchup from the sachet immediately upon opening, in some cases resulting in ketchup being displaced from the sachet onto fingers, clothing, a restaurant table, or other undesired locations; (6) difficulty in tear initiation; (7) esthetic issues such as irregularities in configuration; and (8) tendency of the sachets to tear in unexpected directions in response to manual opening force, e.g., opening of a longitudinal side seal. These issues are related in part to differences in the sizes and configurations of consumers' fingers, and differences in the magnitude and direction of forces that consumers may apply during use of the sachets, but also to concerns with the sachets themselves.

Beyond the above-discussed consumer satisfaction/performance issues, additional design and manufacturing issues include: (1) the tendency of certain varieties of ketchup to react with packaging materials over time, resulting in leakage and/or other problems if the ketchup is not hermetically sealed within an interior layer of suitably corrosion-resistant material, (2) the need for the packet to have suitable oxygen barrier, moisture barrier and other properties to protect the ketchup from deterioration so that the ketchup remains fresh for a period of several months, and (3) selection of design parameters that enable the sachet to contain a desired volume of product without bursting or leaking during manufacture, storage, transportation and use, without using excessive amounts of packaging material. The sachets need to be capable of withstanding bursting forces associated with significantly decreased exterior pressure if they are to be used for airline meals, or if they are to be transported at high elevations between manufacturing locations and their ultimate destinations. Also, the sachets should be able to withstand dynamic forces associated with handling during which the sachets may contact each other while tumbling or otherwise moving relative to each other, without inadvertently tearing open due to such contact.

Some of the same or similar issues can be encountered with sachets for other condiments such as, e.g., mustard, mayonnaise, honey, syrup, cream cheese, jam, jelly, sweet relish, tartar sauce, hot sauce, barbecue sauce, steak sauce, cocktail sauce, taco sauce, salad dressing, mint sauce, soy sauce, horseradish sauce, lemon juice, and vinegar.

Spouted sachets having narrow dispensing spouts can be helpful in addressing some of the above issues, e.g., controlled tearing during opening, and consumers' regulation of dispensing directions and volume flow rates. However, known spouted sachets have significant drawbacks. For example, with certain varieties of ketchup which may be characterized as having very high viscosity, and being non-Newtonian, thixotropic fluids, designing spout dimensions that enable efficient use of packaging material while also providing acceptable flow rates under widely varying conditions can be challenging. Various consumers may apply widely varying pressures over widely varying areas of the sachets during use, and the sachets may be used at widely varying temperatures, e.g., at outdoor events in cold weather such as football games, where the sachets may be at temperatures below 32° F., or at outdoor events in hot weather such as baseball games, at temperatures above 90° F. Further, with certain condiments, inclusions or thickening of fluids over time may impede flow to varying degrees, resulting in inconsistent dispensing performance. Also, the ratio of product volume to packaging material in spouted sachets may be significantly lower than for simple, rectangular sachets of similar sizes, which may create a need for improvements in sachet design and manufacturing processes to decrease costs. Another issue with some spouted sachets is that similar sachets may have different flow characteristics if their lines of weakness are positioned at slightly different locations relative to a tapered dispensing spout, leading to consumer dissatisfaction due to inconsistent performance related to significant differences in the sizes of their dispensing openings. Also, providing sachets in which the spout is consistently centered can be challenging. Where multiple sachets are formed, filled and sealed simultaneously from webs of film, spouts along one side of the operation may be off-center in one direction while spouts on the opposite side are off-center in the opposite direction.

Another issue with production of spouted sachets is that they tend to have larger sealing areas. This may result in a greater likelihood of droplets or other small quantities of a food product dripping onto seal areas from filling tubes during high speed commercial form-fill-seal operations, resulting in the small quantities of food product being trapped between front and back walls of the sachets or packets in seal areas as the seals are formed. When adapting form-fill-seal equipment to change from production of non-spouted sachets to production of spouted sachets, greater force may be required to apply adequate sealing pressure to the larger seal areas of the spouted sachets. This can result in strains on equipment components, and can result in difficulties in maintaining the precision required to consistently and reliably form sachets or packets that meet desired quality standards at desired rates of production.

There is a need for improved, filled sachets that address the above-identified issues, and a need for improved methods of making such sachets efficiently at competitive price points in high-speed commercial mass production.

SUMMARY

Described herein are a packaged food product and methods of making and using the packaged food product. In some embodiments, the packaged food product comprises a spouted sachet or packet containing one or more flowable food products, such as ketchup or other condiments.

In some embodiments, the packaged food product may comprise a quantity of 2 g to 18 g of ketchup having a viscosity characterized by displacement of between 2 cm and 4.5 cm in 30 seconds on a Bostwick Consistometer at 68° F., a specific gravity of 1.10 to 1.16, and a pH of 3.8 to 4.0; a front wall comprising a first film made of from one or a combination of aluminum foil and polymer materials, wherein the front wall has a thickness of 2 to 3.5 mils; and a back wall comprising a second film made of from one or a combination of aluminum foil and polymer materials, wherein the back wall has a thickness of 2 to 3.5 mils.

The first film and the second film may be sealed together to define a sachet capable of containing the ketchup for a period of at least nine months at temperatures of 68° F. to 78° F. without significant degradation of the film or ketchup. The sachet may have a bottom edge, a bottom seal, a pair of side edges and side seals extending away from the bottom edge, a top seal extending between the side seals, and a chamber between the first film and the second film, the chamber having a top and a bottom.

The chamber may have a neck at the top of the chamber, the neck having a lower funnel portion, and an upper spout portion, with graphics and tear initiation notches of a length no more than 0.125 in. provided on each side of the spout to define a desired tear line location.

In some embodiments, the upper spout portion has a cross-sectional area of 0.02 to 0.12 in.$^2$ at the desired tear-line location.

DETAILED DESCRIPTION

Figure 1:
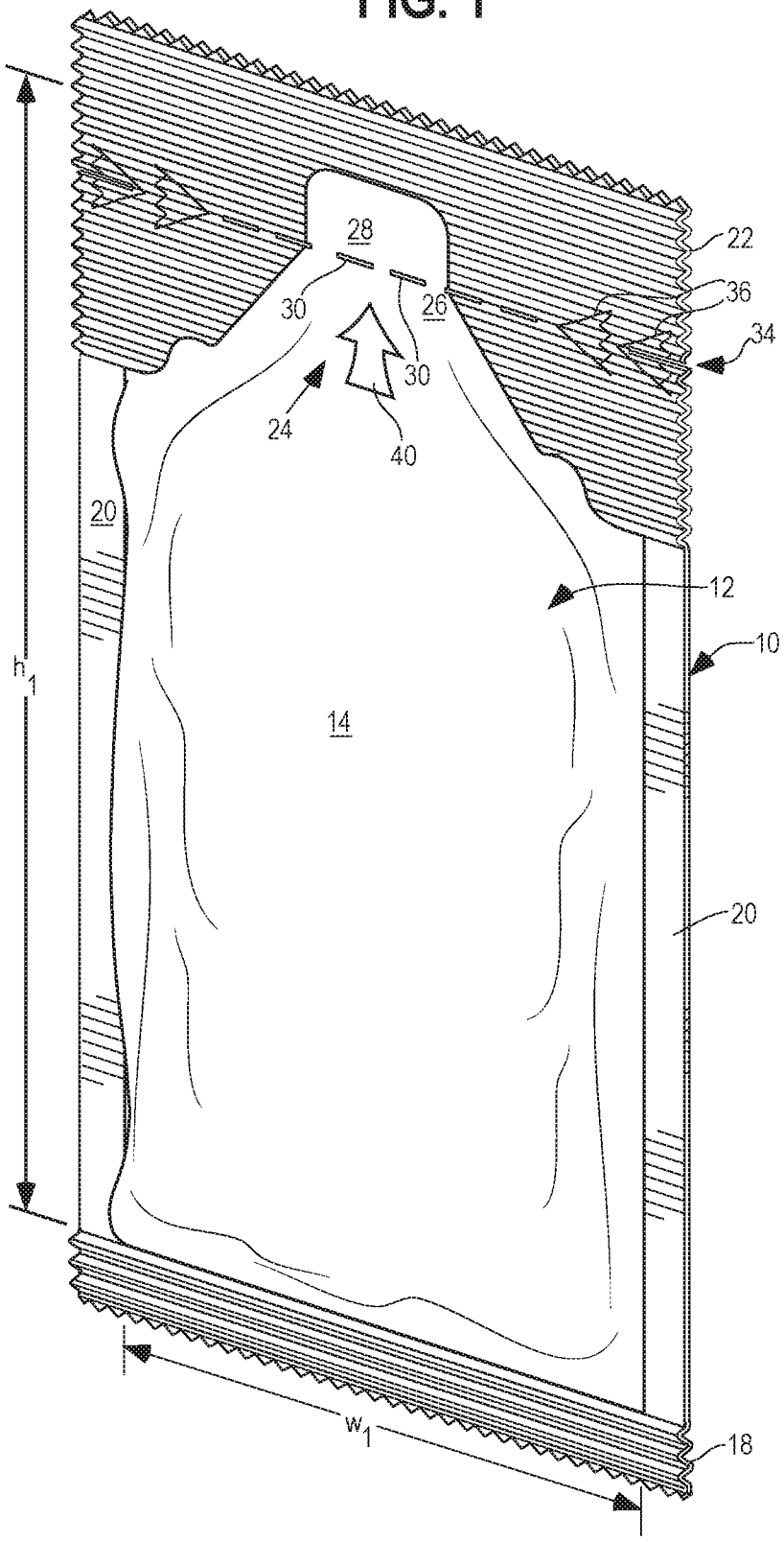
FIG. 1 is an isometric view of a first embodiment.
Figure 2:
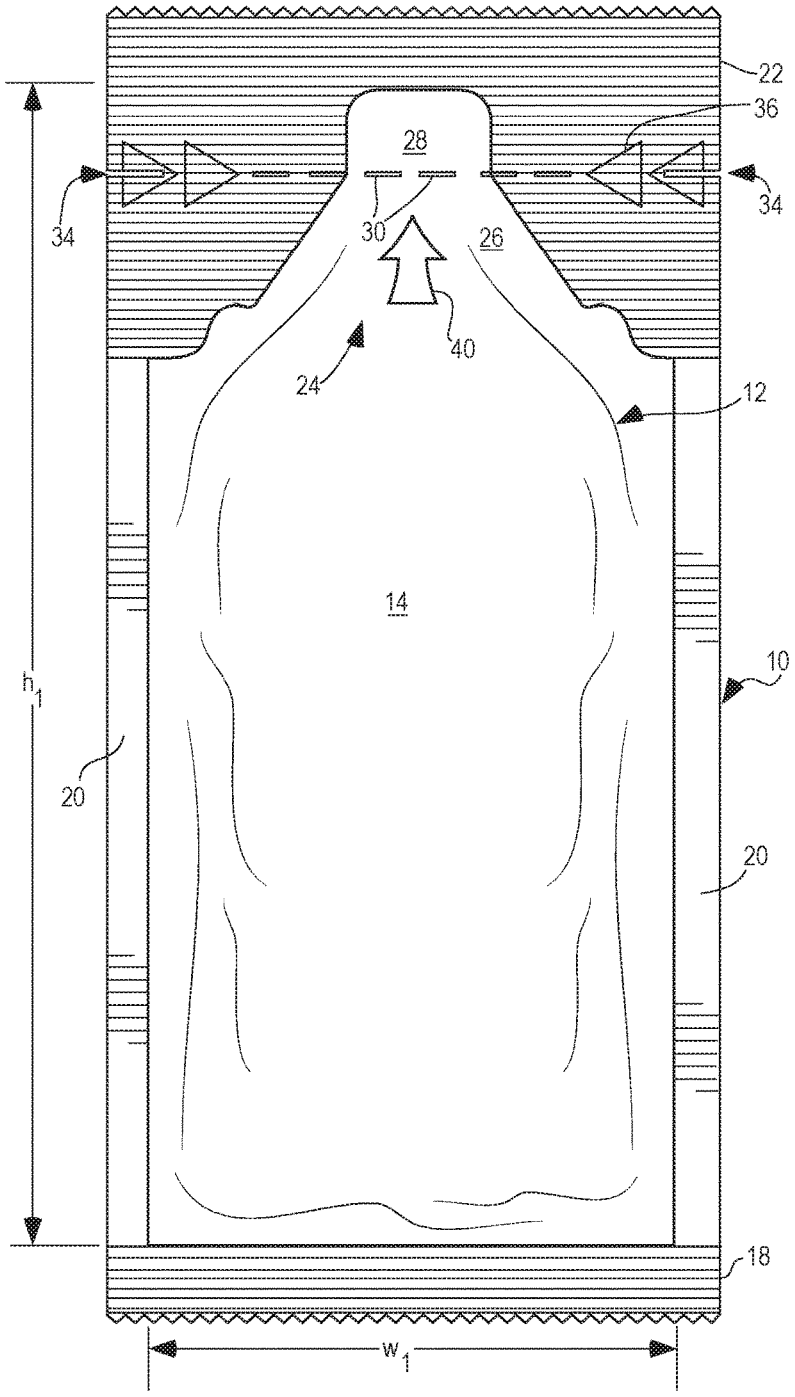
FIG. 2 is a front view thereof.
Figure 3:
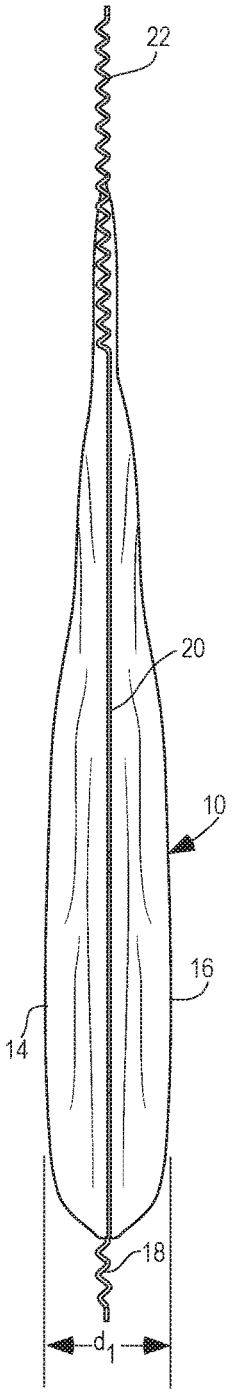
FIG. 3 is a side view thereof.
Figure 4:
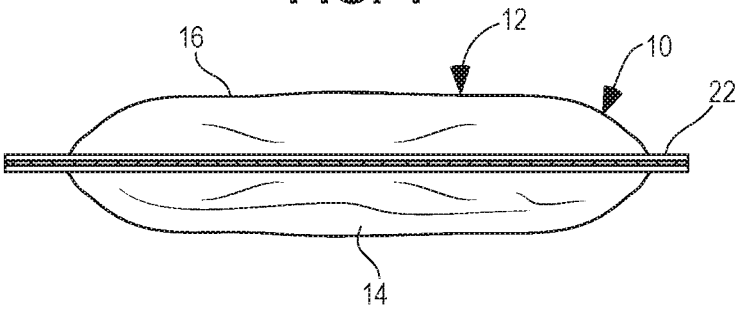
FIG. 4 is a top view thereof.
Figure 5:
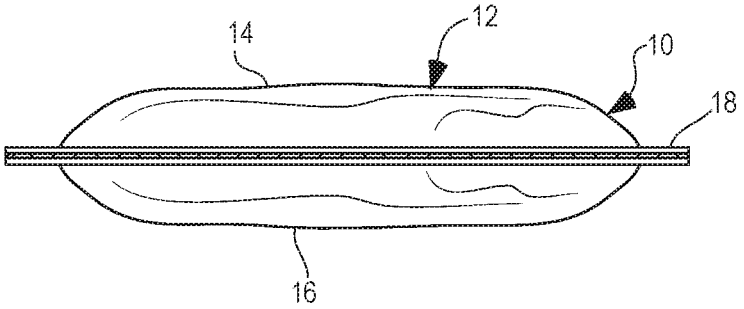
FIG. 5 is a bottom view thereof.

Described herein are a packaged food product and methods of making and using the packaged food product. In some embodiments, the packaged food product comprises a spouted sachet or packet containing one or more flowable food products, such as condiments. Suitable flowable food products may include, for example, ketchup, mustard, mayonnaise, honey, syrup, cream cheese, jam, jelly, sweet relish, tartar sauce, hot sauce, barbecue sauce, steak sauce, cocktail sauce, taco sauce, salad dressing, mint sauce, soy sauce, horseradish sauce, lemon juice, and vinegar. In some embodiments, the sachet may contain Heinz® Tomato Ketchup having the following ingredients, listed in decreasing order of their proportions: tomato concentrate from red ripe tomatoes, distilled vinegar, high fructose corn syrup, corn syrup, salt, spice, onion powder, natural flavoring.

In various embodiments, the mass of product in each sachet may be, e.g., 7 to 11 g, 6.5 to 7.5 g, 8.5 to 9.5 g, 9.5 to 10.5 g, 10.5 to 11.5 g, about 7 g, about 9 g, about 10 g, or about 11 g.

In some embodiments, the packaged food product comprises a spouted sachet or packet containing one or more flowable food products, such as condiments. In some embodiments, the one or more flowable food products consists of 2 g to 18 g of Heinz ketchup having a viscosity characterized by displacement of between 2 cm and 4.5 cm in 30 seconds on a Bostwick Consistometer at 68° F., a specific gravity of 1.10 to 1.16, and a pH of 3.8 to 4.0.

One of the challenges associated with providing a sachet for ketchup is that ketchup tends to react with many packaging materials over time in ways that are detrimental to one or both of the ketchup and the packaging materials. In some embodiments, a hermetically sealed ketchup sachet may have a shelf life of about 9 to 12 months at ambient temperatures. That is, the sealed sachets are capable of withstanding storage at room temperature for 9 to 12 months without significant deterioration of the sachet material or the ketchup. In some embodiments, achievement of the desired shelf life for a ketchup sachet is achieved by making the sachet of a material that includes at least one foil barrier layer, e.g., an aluminum foil layer, and/or one or more metallized polymer layers. In some embodiments, the materials may include PET, APET, OPET, MET-PET, PE, LDPE, LLDPE, mLLDPE, HDPE, mPE, EVA, PP, mOPP, PS, HIPS, foil, EVOH, polyamide, Nylon, PVC, biaxially oriented materials, and combinations thereof.

In some embodiments, OPP (oriented polypropylene) film may be employed as a material for a layer in the sachet. With OPP, the polypropylene film may be biaxially oriented or monoaxially oriented with respect to the form fill seal machine. In creating non-spouted sachets, the OPP may be oriented to run in a vertical direction on a form fill seal machine. When non-spouted sachets are created, the orientation of the polypropylene may then be longitudinal with the sachet so that when a tear is initiated by a user the tear may be parallel with the orientation, which may facilitate initiation and control of the tear when tearing is intended to proceed downward from the top edge.

Figure 8:
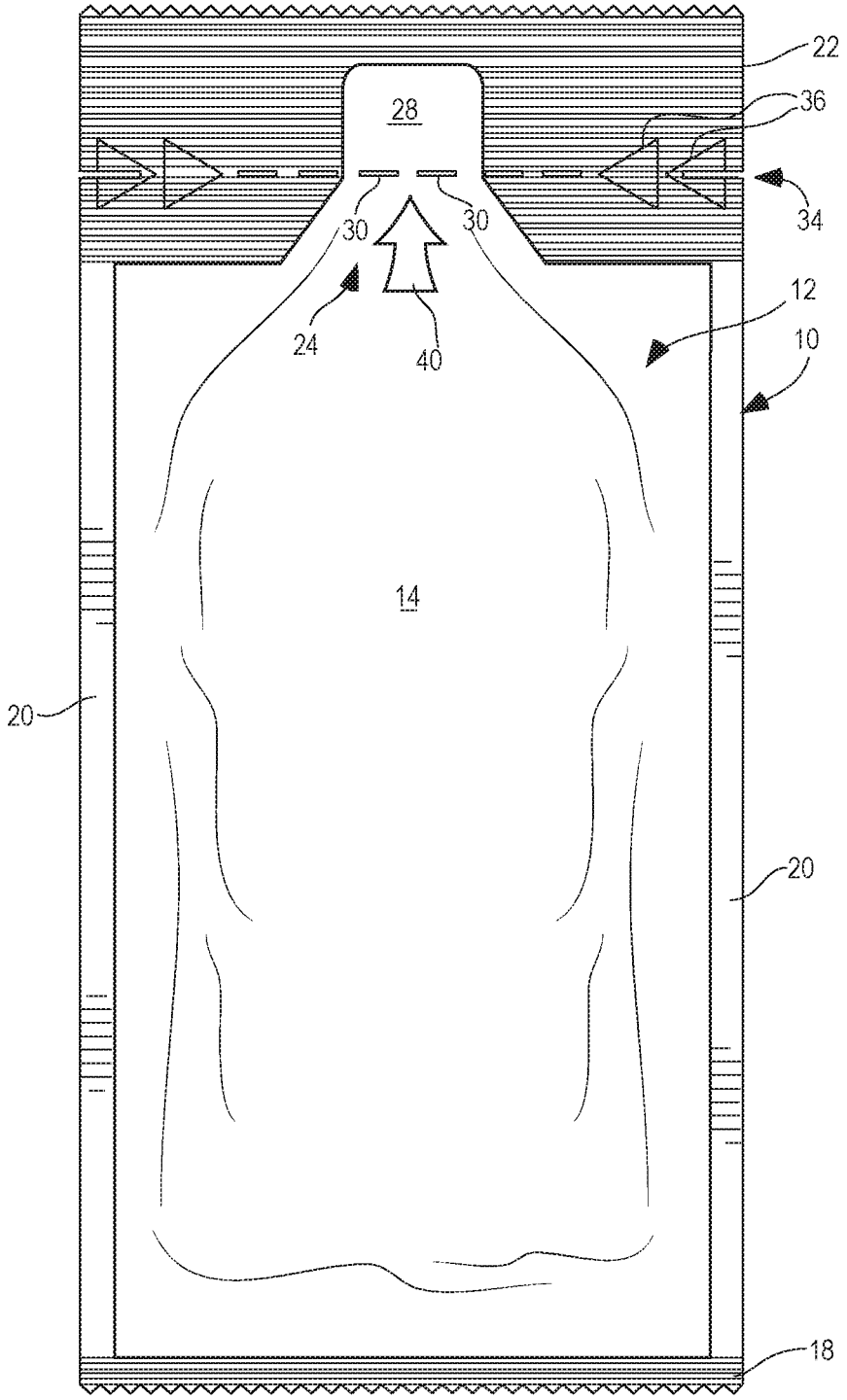
FIG. 8 is a front view of a second embodiment which is identical to the first embodiment except as shown and described.

In forming some spouted sachets such as those illustrated in FIGS. 1 and 8, the OPP film may run in a vertical direction on a form fill seal machine, and the sachets shown in FIGS. 1 and 8 may be formed with OPP oriented vertically, such that the OPP film will tear more easily in a vertical direction than in other directions. This orientation of the OPP film may cause issues with control of the tear, where it is desired that the sachet material tear horizontally across the spout. In some instances, a user may initiate a horizontal tear using one of the notches 34, but continued application of force by the user may result in the tear undesirably curving upward to run parallel to the orientation of the OPP material, toward the top of the sachet, thereby missing the spout and not opening the sachet at all. In other instances, the tear may undesirably curve down to run parallel to the orientation of the OPP film toward the bottom of the sachet, thereby missing the spout and opening the chamber where the ketchup is stored. This problem may be avoided in some cases by orienting the OPP film horizontally. However, in some cases, use of a vertically-oriented OPP film may be desired, even though horizontal tear propagation is desired during use of the sachet.

In some embodiments, where a vertically-oriented OPP material is used, control of the tear's direction may be addressed by providing a line of weakness or other area of weakness to help direct the tear. To this end, in some embodiments, a horizontal laser score may be applied to the OPP material and/or to one or more other layers of the front and/or back wall material to create a line of weakness. In other embodiments, a horizontal line of weakness may be created by one or more slits or cuts on one or both sides of the spout. Such slits or cuts may be made with cutting dies, knives, razors, or other apparatus, and may comprise, e.g., a single long cut with linear edges on each of the spout, or a series of short, jagged or irregular cuts on each side of the spout.

In some embodiments, in addition to or instead of providing areas of weakness to help guide the direction of the tear line, sealing of the sachet may help to guide tearing in a horizontal direction, e.g., by forming a corrugated seal area with ribs and grooves extending horizontally, such that tearing may tend to proceed along a single groove, or generally parallel to the ridges and grooves. When converting equipment from use in making non-spouted sachets with a vertically-oriented OPP film layer to use in making spouted sachets, sealing of the sachet in a manner that facilitates horizontal tearing, and more specifically tearing across the spout to create a dispensing opening, may be preferable to other means of facilitating such tearing such as provision of an area of weakness, or changing the orientation of the OPP material.

In some embodiments, the spouted sachet may have a front wall and a back wall. The walls may be the same material, or may be different. Each wall may include an oxygen barrier, a moisture barrier, and an outer layer capable of supporting high quality graphics while withstanding contact with other objects. In some embodiments, a single layer may perform multiple functions. For example, a single layer may function as both a moisture barrier and an oxygen barrier. The sachet is preferably capable of withstanding friction with other sachets during shipping and handling, as well as being capable of withstanding handling by consumers during normal use, without its mechanical properties or appearance being significantly compromised. In some embodiments, each wall may be made of a material having an overall thickness of 2 to 3.5 mils comprising one or more layers of the following materials: aluminum foil, metalized polymer material, saran, polyethylene, polypropylene, and polyester. Other polymers may also be employed instead of and/or in addition to those mentioned above. In some embodiments, the first wall and second wall are made from the same material or combination of materials. In other embodiments, the first wall and second wall are made from different materials or combinations of materials. One or both walls may be partially or entirely opaque, translucent, or transparent.

In some embodiments, a front wall made of a first multilayer film and a back wall made of a second multilayer film are sealed together to define a sachet capable of containing ketchup for a period of at least nine months at temperatures of 68° F. to 78° F. without significant degradation of the film or ketchup. In some embodiments for other flowable food products, the sachets are capable of containing the flowable food product for a period of at least three months at temperatures of 68° F. to 78° F. without significant degradation of the film or flowable food product. In some embodiments where sachets contain a flowable food product such as a salad dressing that does not include preservatives, the sachets are capable of containing a flowable food product for a period of at least three months, but refrigeration at temperatures below 40° F. is desirable to maintain freshness of the flowable food product.

FIGS. 1-5 illustrate a first embodiment comprising a sachet 10 having a chamber 12 defined between a front wall 14 and a back wall 16 which are joined to one another by a bottom seal 18, side seals 20 extending upward therefrom and a top seal 22.

The chamber 12 has a height "$h_1$," a width "$w_1$" and a maximum depth "$d_1$," and, in some embodiments, can hold 2 g to 18 g of ketchup. The chamber 12 includes a neck 24 at its upper end. The neck 24 has a tapered lower funnel portion 26 that tapers such that its width and depth decrease toward its upper end to funnel ketchup into an upper spout portion 28.

In the illustrated embodiments, a series of printed line segments 30 extends across the upper spout portion 28 perpendicular to a longitudinal axis extending from the top to the bottom of the sachet 10. The series of line segments 30 can indicate to the user a location at which the spout may be torn or cut to permit dispensing of the flowable product. Additional graphics in the illustrated embodiments include a respective pair of inwardly pointing triangular arrows 36 near each edges of the sachet aligned with the series of line segments 30, and an upwardly pointing arrow 40 centered between the vertical edges of the packet just below the line segments to direct the user's attention to the tear location and the spout. In some embodiments, the graphics may include more or less than two inwardly-directed arrows at the desired tear line location. Arrows may include triangles, chevrons, or other shapes that may be effective to call attention to notches. The graphics are preferably configured to be sufficiently prominent to provide guidance to users, including those with visual impairments, without being so large or prominent as to be esthetically unacceptable. In various embodiments, the height and width dimensions of each arrow may be between about 0.18 in and about 0.3 in. In some embodiments, the upwardly pointing central arrow 40 may be, e.g., between about 0.35 in and about 0.45 in. in height and between about 0.25 in. and about 0.35 in. in width.

The dimensions and shape of the dispensing opening formed when a cut or tear is formed across the spout can be significant in terms of facilitating controlled dispensing of a bead or stream of flowable product at a desired flow rate. Some users may wish to dispense the entire contents of the sachet quickly onto a large group of food items or other large target, without requiring a great deal of precision. Others may wish to dispense a narrow bead of a flowable product such as ketchup onto a single small food item or other small target with a great deal of precision. In some embodiments, removal of an end portion of the spout by tearing or cutting the end portion away may facilitate controlled dispensing of ketchup at various rates to accommodate a range of user preferences where the resulting dispensing opening is bounded by remaining sachet material that may assume an approximately rhombus-shaped, approximately elliptical, or approximately circular configuration, and wherein sachet has a spout cross-sectional area at the dispensing opening of, e.g., 0.02 to 0.12 in.$^2$, 0.02 to 0.1 in.$^2$, 0.03 to 0.12 in.$^2$, 0.03 to 0.1 in.$^2$. In some embodiments, means to facilitate tear initiation such as notches, tears, slits or areas of weakness extend inward from one or both side edges of the sachet at one or more desired tear locations. In the illustrated embodiment, notches 34 are provided at both side edges to facilitate tear initiation.

One consideration in providing means to facilitate tear initiation is avoidance of inadvertent opening of or damage to the sachets. It is believed that inadvertent opening, leading to leakage, could occur in some sachets during shipping and/or handling when large numbers of sachets are tumbling or otherwise moving relative to one another, particularly if notches in edges allow sachets to interact with each other in a way that permits one sachet to apply an opening force to another. Another consideration is that provision of edge notches may increase the likelihood of sachets being deformed during shipping and handling such that their appearances may be concerning to consumers. Metalized polymer material may be more elastic than certain other materials, such as aluminum foil based materials. A sachet that is made of a metalized polymer material may reform more quickly and fully to its original shape after deformation. Thus, increased risk of inadvertent opening or undesirable deformation may be present for aluminum foil based materials, and this may be a consideration in selection of materials for the sachets, and/or in provision of notches or the like in such sachets.

In some embodiments, means to facilitate tear initiation are near the top of the neck so that very little food product may be contained in the sachet above the tear line. However, this may create a risk that a tear line will be formed above the end of the spout. Therefore, in other embodiments, the means to initiate tearing are substantially aligned with the middle of the spout, i.e., about half way between the top and bottom of the spout, to increase the likelihood that the opening will be formed across the spout.

In some embodiments, the first film and the second film are contoured to form the chamber. In some embodiments, the first film and the second film are stretched to form the chamber. The depth of the chamber may depend on factors such as sizes and configurations of fill tubes used during forming and filling of the sachets, separation of pull wheels on the form fill seal machine, the speed of the form fill seal machine, piston speed and type, I-Bar/cut-off settings, and desired volumetric fill for each sachet.

In some embodiments, one or more of the following features may be employed to help control flow rates during dispensing. The upper spout portion may have a maximum depth about 65% less than the maximum depth of the chamber; the lower funnel portion of the neck may have a maximum width between about 40% and 56% of the width of the chamber; and the width of the funnel may decrease by approximately 25% to 58% from bottom to top.

In some embodiments, the lower funnel portion of the neck may have a maximum width approximately equal to the width of the chamber.

In some embodiments, the length of the upper spout portion is between about 36% and 60% of the length of the neck.

As noted above, in some embodiments, in addition to notches for initiating tearing, one or more areas of weakness may be provided inward thereof and substantially aligned therewith to facilitate formation of a tear line at a desired location. The area of weakness may include one or more perforations on one side of the upper spout portion, and one or more perforations on the opposite side of the upper spout portion. In some embodiments, the area of weakness may comprise a single line of multiple slits through both the first film and the second film. In some embodiments, the line of weakness may comprise a continuous or intermittent laser score or other score line that does not extend entirely through either the first film or the second film. In some embodiments, the area of weakness may comprise a series of short, jagged or irregular cuts on the either or both sides of the upper spout portion. Such short, jagged or irregular cuts may be made with knives. However, the size of the cuts may be a concern. If the cuts are too long or wide, there may be an increased risk of inadvertent opening or leakage, or undesirable deformation during shipping and handling.

In some embodiments, the cross-sectional area of the upper spout portion is approximately 16% of a maximum cross-sectional area of the chamber.

In some embodiments, a method of making the packaged food product may comprise providing a first web of laminated material; providing a second web of laminated material; pressing the first web and second web together to form individual sachets; filling the individual sachets with a flowable material such as ketchup; and sealing the individual sachets to form a spout in each individual sachet.

In some embodiments, multiple sachets, e.g., 8, 10 or 12 sachets, are formed simultaneously and in parallel. In some embodiments, the sachets are manufactured using a vertical form fill seal machine.

In some embodiments, to combat the increased cost of manufacturing a spouted sachet as compared to a traditional ketchup sachet, the widths of the edge seals may be reduced to increase capacity without unnecessarily increasing the amount of material used.

One consideration for the spouted sachet is the increased possibility of the packaged condiment leaking from the seal area, as compared to the prior art sachets. The spouted sachets may have an increased seal area from the prior art sachets, but the form fill seal machine may still apply the same pressure to the seals as it did to the prior art sachets. Using the same amount of pressure to seal an increased area may result in a seal that is not as tight as those seals in the prior art sachets. Also, producing a spouted sachet with an increased seal area may require the same amount of condiment in a smaller footprint, which may cause increased pressure in the chamber. The combination of the looser seals and greater chamber pressure may cause an increased risk of the condiment leaking from the sealed area. One solution may be to increase the size of the chamber by reducing the seal area (as shown in FIG. 8) which, in turn, may reduce the chamber pressure and reduce the possibility of the packaged condiment leaking from the seal area.

Another consideration is that reducing seal area may increase leakage that may occur with some flowable food products due to product separation. For example, over a period of 24 hours to 72 hours, in a sachet containing tomato ketchup, ketchup may separate into serum and tomato paste. The serum may comprise vinegar, water, and other liquid, and may be less viscous than the homogenized tomato ketchup. Leakage of serum may occur, in some cases, 24 to 72 hours after sealing in sachets that did not exhibit leakage earlier. Although this problem may exist in any ketchup packets, reducing seal area may exacerbate the problem. To avoid leakage, adjustments to the form fill seal machine may be required. For example, when seal area is reduced, one or more adjustments such as increased pressure to the seal, increased temperature to the seal, reduced speed of the form fill seal machine to allow more dwell time during sealing, or a combination thereof, may reduce the number of serum leakers in the sachets.

In some embodiments, a method of using the packaged food product may comprise holding the sachet with one hand below the desired tear line location; simultaneously holding the sachet above the desired tear line location with the other hand; applying a manual shearing force across the desired tear line location; continuing the application of manual shearing force until an upper portion of the sachet has been separated from the remainder, and a dispensing opening has been created wherein the inside of the spout is exposed; and squeezing the sachet so that the ketchup is expelled and directed to a desired location.

Figure 6:
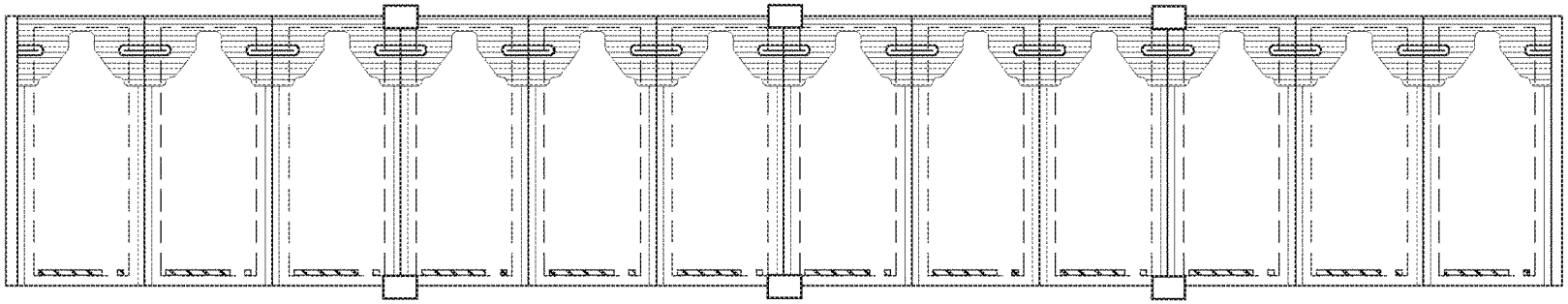
FIG. 6 is a front view of a web of material that may be used to form sachets.
Figure 7:
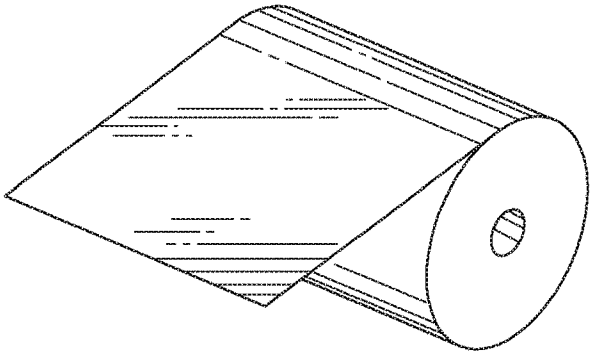
FIG. 7 is an isometric view of a roll of the web material of FIG. 6.

In some embodiments, a web of material like that shown in FIGS. 6 and 7 can be used in a vertical form-fill-seal operation to produce filled sachets as described herein.

FIG. 8 illustrates a sachet corresponding to a second embodiment. The second embodiment is substantially the same as the first embodiment except as shown in FIG. 6 and described below.

In the second embodiment, a sachet 10 has a chamber 12 defined between a front wall 14 and a back wall 16 which are joined to one another by a bottom seal 18, side seals 20 extending upward therefrom and a top seal 22. The chamber 12 includes a neck 24 at its upper end. The neck 24 has a tapered lower funnel portion 26 that tapers such that its width and depth decrease toward its upper end to funnel ketchup into an upper spout portion 28. In this second embodiment, the lower funnel portion 26 of the neck 24 has a maximum width less than the width of the chamber 12, and, therefore, less volume than the lower funnel portion 26 of the first embodiment. However, the chamber 12 in the second embodiment has a greater volume capacity.

In various embodiments, the top seal may have a number of ribs or grooves between the desired tear line location and the chamber (e.g., 1, 2, 3, 4, 5, 6 or 7 ribs) and a number of ribs or grooves between the desired tear line location and the top edge of the of the sachet (e.g., 1, 2, 3, 4, 5, 6 or 7 ribs).

To the extent that packaged food products are described herein with terms suggesting a particular orientation, e.g., as having a bottom, top, front, back and sides, such these terms are intended only to facilitate description of positions of various parts of packaged food products relative to other parts, and are not otherwise intended to be limiting in any way. The packaged food products described herein may of course be positioned in various orientations during use. Words, logos, pictures, etc. may be oriented in ways that correspond to the orientation suggested by the description herein, or in any other way.

As noted above, in some embodiments, the sachets may be formed from an aluminum foil material that exhibits more plastic deformation than that of the metalized polymer material. More specifically, when an external force such as a bending moment is applied to the top seals of the respective sachets to fold over respective top corners thereof, the metalized polymer material tends to behave more elastically. That is, when the force is removed, the metalized polymer material springs back more quickly, and returns more closely to its original shape. This more plastic deformation may cause problems during shipping and handling, in that if perforations for opening the sachet extend to the sides of the sachet, then large notches are created where two sachets can hook together. This might potentially cause sachets to tear and leak. It might also be undesirable from the standpoint of creating difficulty or delay when a person, such as a restaurant employee, wishes to take a single sachet from a container that holds multiple sachets. To avoid this type of problem, in some embodiments, perforations between the spout and the sides of the sachet do not extend to either side of the sachet, so that the sides of the sachets remain intact, continuous, and uninterrupted. No notches or other discontinuities are created on the edges of the sachets which could cause them to catch on each other.

In some embodiments, approximate cross-sectional areas of both the spout and of the chamber, taken at locations where the interior is pressurized, may be approximately equal to areas bounded by ellipses. In one approach, half of the width in a particular plane perpendicular to a longitudinal axis of the sachet may be treated as a major radius (a) of an ellipse, and half of the depth at the same location may be treated as a minor radius (b) of the ellipse. The approximate cross-sectional area of the sachet in the selected plane may thus be calculated using the formula for the area circumscribed by an ellipse, i.e., area=$\pi ab$.

In some embodiments, cross-sectional areas of both the spout and of the chamber, taken at locations where the interior is pressurized, may be approximately equal to areas bounded by rhombuses. In one approach, the width in a particular plane perpendicular to a longitudinal axis of the sachet may be treated as a one diagonal (p) of a rhombus, the depth at the same location may be treated as a second diagonal (q) of the rhombus. The approximate cross-sectional area of the sachet in the selected plane may thus be calculated using the formula for the area circumscribed by a rhombus, i.e., area=$pq/2$.

In some embodiments, the cross-sectional area of the dispensing opening may be approximately equal to an area bounded by a circle, and may be measured by opening the pouch, then inserting a measuring device into the open end of the spout to measure its diameter (d) or circumference (c). The approximate cross-sectional area of the sachet in the selected plane may thus be calculated using the formula for the area circumscribed by a circle, i.e., area=$\pi d^2/4$ or $c^2/4\pi$.

Each of the various features described above may be used in combination with any other compatible features described above. Various aspects of the products and processes described herein are further described in the following claims.

The invention claimed is:

1. A packaged ketchup product comprising:

a quantity of ketchup having a viscosity characterized by displacement of between 2 cm and 4.5 cm in 30 seconds on a Bostwick Consistometer at 68° F., a specific gravity of 1.10 to 1.16, and a pH of 3.8 to 4.0;

a front wall comprising a first film made of from one or a combination of aluminum foil and polymer materials, wherein the front wall has a thickness of 2 to 3.5 mils;

a back wall comprising a second film made of from one or a combination of aluminum foil and polymer materials, wherein the back wall has a thickness of 2 to 3.5 mils;

wherein the first film and the second film are sealed together to define a sachet capable of containing the ketchup for a period of at least nine months at temperatures of 68° F. to 78° F. without significant degradation of the film or ketchup, the sachet having a bottom edge, a bottom seal, a pair of side edges and side seals extending away from the bottom edge, and a top seal extending between the side seals;

a chamber between the first film and the second film, the chamber having a top and a bottom;

wherein the chamber has a height, a width and a depth and can hold 2 g to 18 g of ketchup;

the chamber having a neck at the top of the chamber, the neck having a lower funnel portion, and an upper spout portion, each of which has a top, a bottom, a height, a width and a depth;

wherein the width and depth of the lower funnel portion decrease from bottom to top;

wherein graphics and tear initiation notches of a length no more than 0.275 in. are provided on each side of the spout to define a desired tear line location; and wherein the upper spout portion has a cross-sectional area of 0.02 to 0.12 in.$^2$ at the desired tear line location.

2. The packaged ketchup product of claim 1 wherein the upper spout portion has a cross-sectional area of 0.03 to 0.1 in.$^2$ at the desired tear line location.

3. The packaged ketchup product of claim 1 wherein the quantity of ketchup comprises about 9 g of ketchup.

4. The packaged ketchup product of claim 1 wherein the quantity of ketchup comprises 7 to 11 g of ketchup.

5. The packaged ketchup product of claim 1 wherein the wherein the graphics and tear initiation notches are substantially aligned with a central portion of the neck.

6. The packaged ketchup product of claim 1 wherein the first film and the second film are contoured to form the chamber.

7. The packaged ketchup product of claim 1 wherein the first film and the second film are stretched to form the chamber.

8. The packaged ketchup product of claim 1 wherein the upper spout portion has a maximum depth about 65% less than a maximum depth of the chamber.

9. The packaged ketchup product of claim 1 wherein the width of the lower funnel portion of the neck has a maximum width between about 40% and 56% of the width of the chamber.

10. The packaged ketchup product of claim 9 wherein the width of the funnel decreases by approximately 25% to 58% from bottom to top.

11. The packaged ketchup product of claim 1 wherein the width of the lower funnel portion of the neck has a maximum width approximately equal to the width of the chamber.

12. The packaged ketchup product of claim 1 wherein the length of the upper spout portion is between about 36% and 60% the length of the neck.

13. The packaged ketchup product of claim 1 wherein the side seals are no wider than 0.1 in.

14. The packaged ketchup product of claim 13 wherein the bottom seal is no wider than 0.2 in.

15. The packaged ketchup product of claim 1 wherein the side seals have a width of 0.2 in.

16. The packaged ketchup product of claim 1 wherein the bottom seal has a width of 0.3 in.

17. The packaged ketchup product of claim 1 wherein a series of a short, jagged cuts is formed on at least one side of the upper spout portion.

18. The packaged ketchup product of claim 1 wherein the polymer materials comprise oriented polypropylene (OPP) oriented longitudinally of the sachet.

19. A method of making the packaged ketchup product of claim 1, the method comprising:

providing a first web of laminated material;

providing a second web of laminated material;

pressing and sealing the first web and second web together to form a row of individual sachets simultaneously;

filling the individual sachets with ketchup simultaneously; and further sealing the individual sachets to hermetically seal the ketchup in the sachets, and to form a spout in each individual sachet, with each spout being centered on its respective sachet.

20. A method of using the packaged ketchup product of claim 1, the method comprising:

holding the sachet below a line of weakness;

simultaneously holding the sachet above the line of weakness;

applying a manual shearing force at the line of weakness to tear the material and create a tear line;

continuing application of manual shearing force to propagate the tear line across the spout to create a dispensing opening; and manually applying pressure to the sachet so that ketchup is expelled through the spout and though the dispensing opening.

* * * * *